US011810439B1

(12) United States Patent
Mahabob et al.

(10) Patent No.: US 11,810,439 B1
(45) Date of Patent: Nov. 7, 2023

(54) STUDENT SAFETY TRACKING SYSTEM

(71) Applicant: KING FAISAL UNIVERSITY, Al-Ahsa (SA)

(72) Inventors: Nazargi Mahabob, Al-Ahsa (SA); Mohamad Aariz, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/206,382

(22) Filed: Jun. 6, 2023

(51) Int. Cl.
*G08B 21/02* (2006.01)

(52) U.S. Cl.
CPC ..... *G08B 21/0272* (2013.01)

(58) Field of Classification Search
CPC ..... G08B 21/0272
See application file for complete search history.

(56) References Cited

U.S. PATENT DOCUMENTS

| | | | | |
|---|---|---|---|---|
| 10,878,686 | B1 | 12/2020 | Pederson et al. | |
| 2011/0084825 | A1* | 4/2011 | John | G08G 1/123 340/539.13 |
| 2014/0176328 | A1* | 6/2014 | Koushik | G06Q 10/08 340/539.13 |
| 2020/0143182 | A1* | 5/2020 | Noh | G06V 20/593 |
| 2021/0006933 | A1 | 1/2021 | Dean | |
| 2021/0248704 | A1* | 8/2021 | Wang | G01C 21/3438 |
| 2022/0068066 | A1* | 3/2022 | Pzynski | H04W 64/006 |

* cited by examiner

*Primary Examiner* — Travis R Hunnings
(74) *Attorney, Agent, or Firm* — Nath, Goldberg & Meyer; Richard C. Litman

(57) ABSTRACT

A safety tracking system is provided, including: a tracking device; a sensor that determines the location of the tracking device; and a safety device that receives the location information from the sensor and activates a safety measure based on the location information.

14 Claims, 5 Drawing Sheets

STUDENT SAFETY TRACKING SYSTEM

FIELD

The present disclosure relates to protecting the safety of people, and particularly to a system and method for protecting the safety of people such as students or members of a group.

DESCRIPTION OF THE RELATED ART

The safety of individuals when traveling with a group is paramount. A group leader usually keeps track of each individual in a group to ensure the safety and well-being of each group member. A list is used in most cases. The group leader will make a count of each individual in the group and will not proceed until everyone in the group is accounted for. There is a high percentage of human error involved and many safety measures are implemented to reduce the amount of human error.

To date, the tools developed to increase safety generally focus on tracking alone. However, by focusing on tracking these tools fail to prevent many negative outcomes.

Thus, a student safety tracking system solving the aforementioned problems is desired.

SUMMARY

Electronic devices can keep track of each individual in a group ensuring the safety and well-being of individuals when traveling. The element of human error will he eliminated making it much safer for each individual in a group.

A device, in one embodiment, is wearable by a student, either in their H) card or on their wrist, which, when the student boards a bus, automatically activates a sensor present in the bus to mark the student's presence on the bus. When the student disembarks the bus, the device will confirm the student has left the bus. If the student has not left the bus, the bus engine will be prevented from being turned off.

A safety tracking system, in another embodiment, includes: a tracking device; a sensor that determines the location of the tracking device; and a safety device that receives the location information from the sensor and activates a safety measure based on the location information.

The tracking device can be a wearable device such as a ring, a bracelet, a card or any other similar item.

The safety measure is activated, in one embodiment, if the location of the tracking device is within a designated bus.

The safety measure may prevent the designated bus engine from being turned off.

The safety measure is activated, in another embodiment, if the location of the tracking device is within a designated room.

The safety measure may make an alert that there is a remaining person in the designated room.

A safety tracking method, in one embodiment, includes: determining a location of a tracking device with a sensor; communicating the location of the tracking device from the sensor to a safety device; and activating a safety measure from the safety device based on the location information.

The tracking device, in some embodiments, is wearable and can be a ring, a bracelet, a card or any other such item.

The safety tracking method can further include activating a safety measure if the location of the tracking device is within a designated bus.

The safety measure can prevent the designated bus engine from being turned off.

The safety tracking method can include activating the safety measure if the location of the tracking device is within a designated room.

The safety measure can make an alert that there is a remaining person in the designated room.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Children are a parent's precious gift and future of a country. Every parent wants to protect their kids and give them a bright and happy future. Unwanted scenarios, sometimes, shatter a parent's dream, due to negligence or unawareness. These kinds of scenarios can be avoided by providing electronic devices to safeguard children.

The student may wear this safety device either in their ID card or on their wrist. When the students board a bus or enter a classroom the electronic device automatically activates a sensor present in the bus or classroom and marks his/her presence in the bus or classroom. While disembarking from the bus or exiting the classroom, the device will give a beep and confirm that the student has stepped outside the bus or classroom. If the student has not left the bus or classroom, it will show the driver or teacher that the student is still present in the bus or classroom, and it will not permit the engine of the bus to be turned off or the door to a classroom to close. Thus, the safety device will prevent unwanted confusion and mishaps.

Figure 1A:
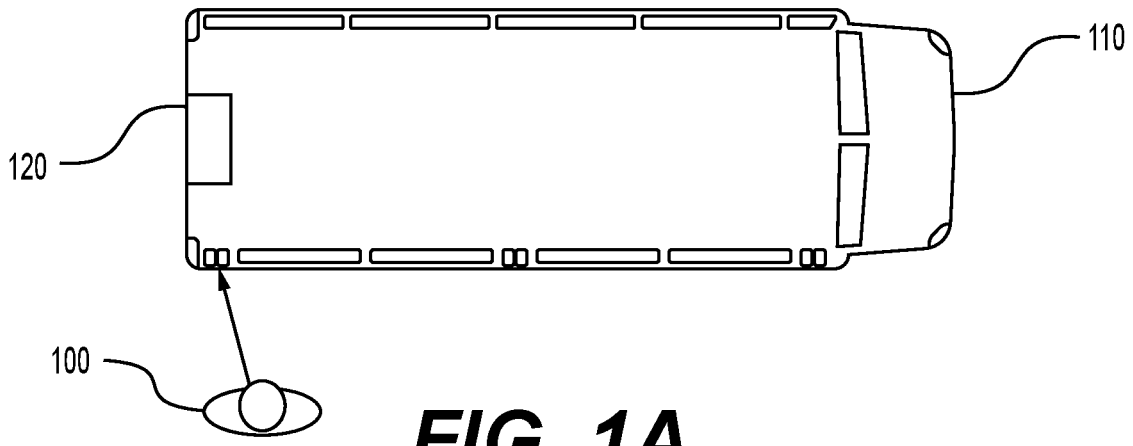
FIG. 1A is an illustration of a student wearing a tracking device and boarding a bus.

FIG. 1A is an illustration of a student 100 wearing a tracking device such as a student ID card, ring or bracelet. The student 100 enters a bus 110 where a sensor 120 activates software that keeps track of and monitors the student 100.

Figure 1B:
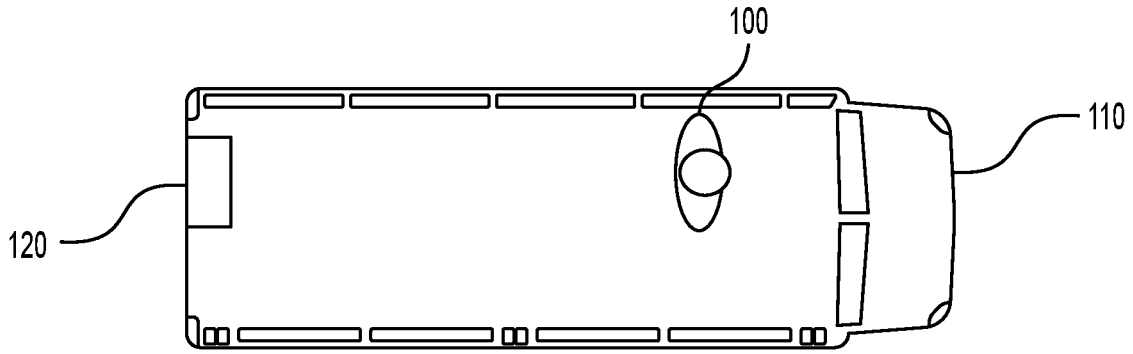
FIG. 1B is an illustration of a student wearing a tracking device on a bus.

FIG. 1B is an illustration of the student 100 present in the bus 110. The software controls a safety device that controls the bus engine and maintains the running of the bus engine.

The safety device prevents the engine from being turned off because of the presence of student 100.

Figure 1C:
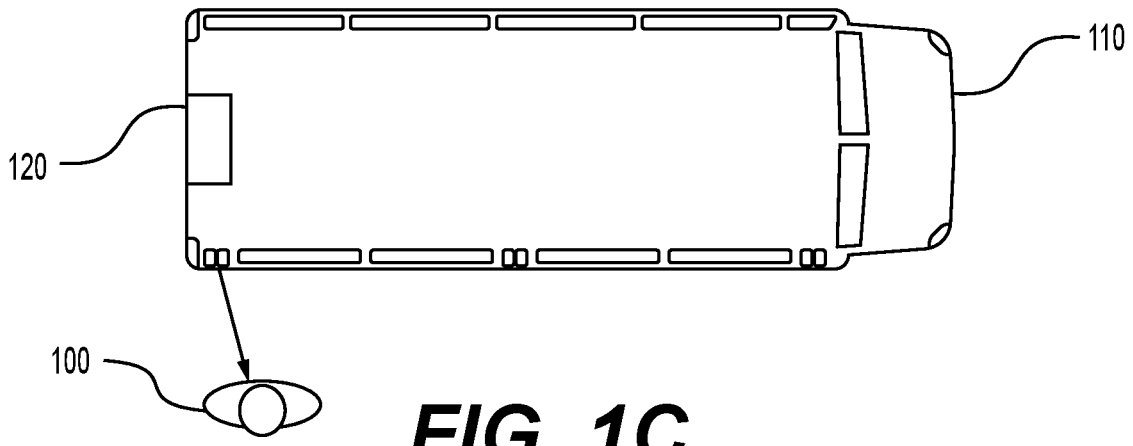
FIG. 1C is an illustration of a student wearing a tracking device exiting a bus.

FIG. 1C is an illustration of the student 100 exiting the bus 110. The sensor identifies the student 100 as leaving the bus. The safety device is alerted that the student 100 has left the bus 110 and allows the engine of the bus to be shut off.

Figure 2A:
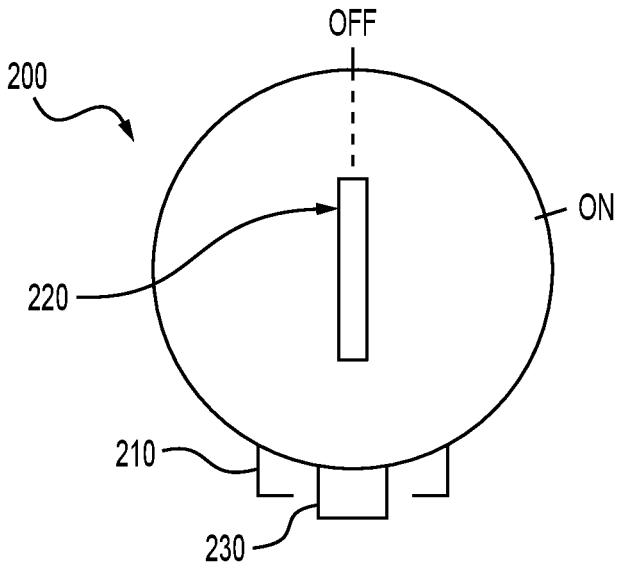
FIG. 2A is an illustration of a vehicle starting system with a safety device.

FIG. 2A is an illustration of a vehicle starting system 200 having a safety device 210. The vehicle starting system has a key hole 220 and a lever 230. The safety device 210 is in an open position leaving the lever 230 in an unlocked state. The engine of the vehicle can be freely turned on and off in this state.

Figure 2B:
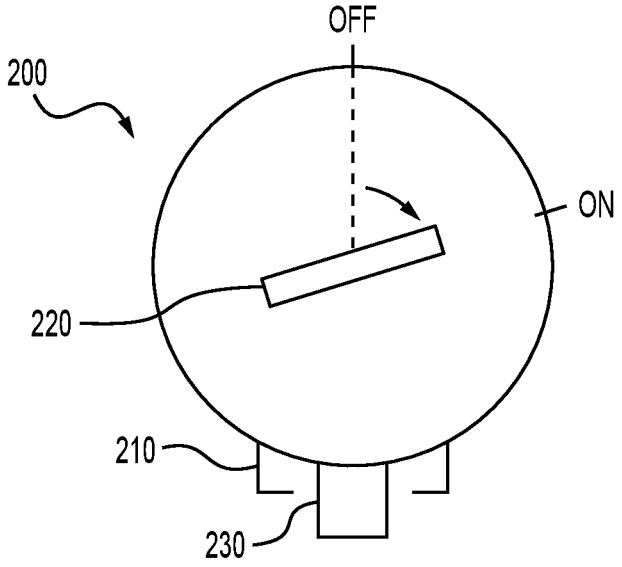
FIG. 2B is an illustration of the vehicle starting system in the ON position.

FIG. 2B is an illustration of the keyhole 220 turned to the ON position. The engine of the vehicle is started in this position. There are no students present on the bus, so the safety device 210 remains in the open position leaving the lever 230 in an unlocked state. Again, the engine of the vehicle can be freely turned on and off in this state.

Figure 2C:
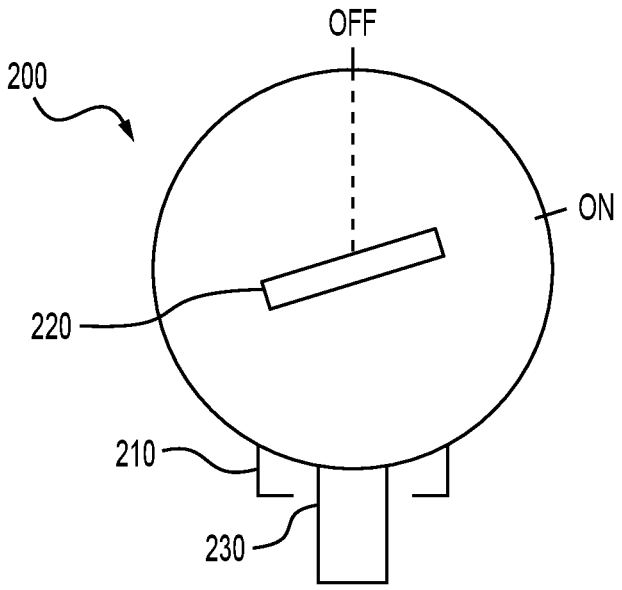
FIG. 2C is an illustration of the vehicle starting system in the ON position with students present on the bus.

FIG. 2C is an illustration of the keyhole 220 turned to the ON position when students 100 enter the bus 110. The sensor 120 detects the presence of students 100 entering the bus 110. Safety device 210 is activated and moved into the locked state which locks the lever 230. In this locked state, the engine of the bus 110 cannot be turned off The lever 230 is prevented from being turned back to the OFF position.

Figure 2D:
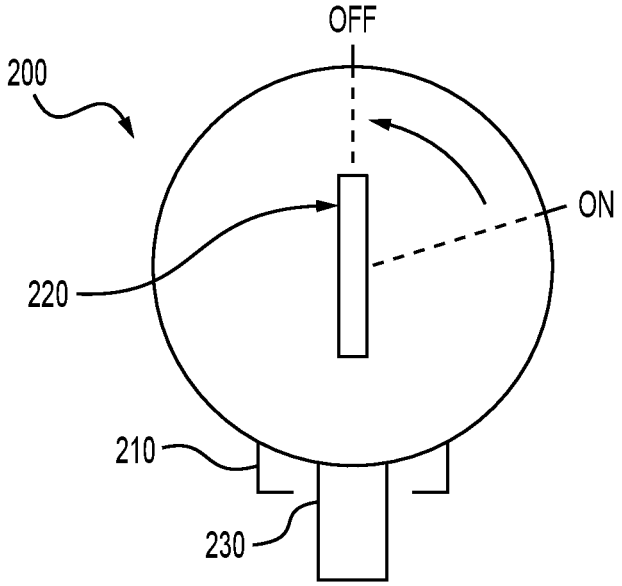
FIG. 2D is an illustration of the vehicle starting system in the OFF position.

FIG. 2D is an illustration of the key hole 220 being turned to the OFF position, after all students 100 disembark from the bus 110. In this scenario, the sensor 120 detects each student leaving the bus and sends a signal to safety device 210 when there are no students present on the bus 110. Safety device 210 is moved into the open position allowing the lever 230 to be moved to the OFF position. The engine of the bus 110 can now be turned off since all students 100 disembarked the bus 110. The lever 230 in this unlocked state can be freely moved to the ON and OFF positions.

In one embodiment, once a student 100 enters the bus 110, Bluetooth software in a tracking device (such as Bluetooth software version 5.0), such as a ring, will pair with software on the bus 110. The safety device 210 will include a display located near the driver of the bus 110. The software will maintain the engine running continuously and it will not permit the bus driver to turn off the engine until all students wearing a tracking device exit the bus 110. This will ensure that no students are left on the bus 100. The ring can be made of corrosion resistant good quality stainless steel and may be equipped with Bluetooth version 5.0, which is easy to use and has speedy connectivity. There will be no need for extra devices. The foregoing is merely an example of software and tracking devices that may be use. There are many other possibilities such as RFD and bracelets, which are know to those skilled in the art and are part of this disclosure.

Figure 3A:
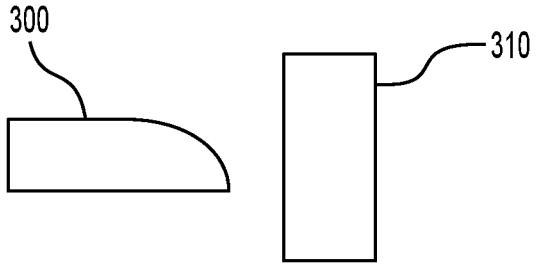
FIG. 3A is an illustration of a safety device in the unlocked position.

FIG. 3A is an illustration of a safety device 300. In the unlocked state, the safety device is in an open position and is not engaged with the lever 310.

Figure 3B:
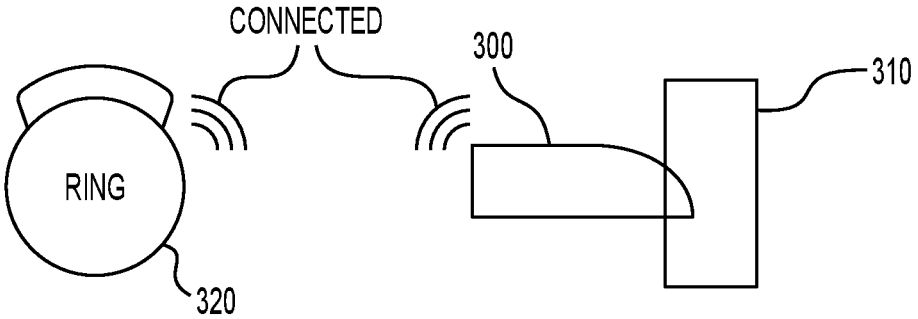
FIG. 3B is an illustration of the safety device when a tracking device is detected.

FIG. 3B is an illustration of the safety device 300 when a tracking device 320 is detected by a sensor. The tracking device 320 is sensed by a sensor indicating the presence of students. Once the presence of students is determined, the safety device 300 moves into closed position, engaging the lever 310 and putting the lever 310 into a locked state.

Figure 3C:
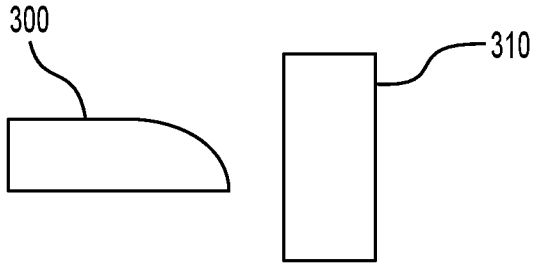
FIG. 3C is an illustration of the safety device when a tracking device is not detected.

FIG. 3C is an illustration of the safety device 300 when no students are detected. As students leave, the sensor tracks the tracking device 320. When there are no more tracking devices present, the sensor alerts the safety device 300, which is then moved into the open position. The lever 310 is disengaged and put into an clocked state, FIGS. 3A, 3B and 3C are generalized illustrations to show how a safety device may operate. For instance the safety device could apply to a lock mechanism as described in relation to an ignition of a bus as described in relation to FIGS. 2A to 2D. FIGS. 3A, 3B and 3C could also apply to a classroom setting where the safety device may allow doors to be locked only when there are no students present in the classroom. The safety device may alternately prevent the lights from being turned off if a student remains in the classroom or sound an alarm if a student is present in the classroom. There can be many different variations depending on the situation and circumstances. For example, there may be an alert if three students remain in the classroom or there may be an alert based on time. Software can control the safety device to meet the needs of a user and can be programmed for any situation or circumstance.

A safety tracking system, in one embodiment, includes: a tracking device; a sensor that determines the location of the tracking device; and a safety device that receives the location information from the sensor and activates a safety measure based on the location information. The tracking device can be a wearable device such as a ring, a bracelet, a card or any other similar item. The safety measure is activated if the location of the tracking device is within a designated bus. The safety measure prevents the designated bus engine from being turned off if students remain on the designated bus. The safety measure is activated, in another embodiment, if the location of the tracking device is within a designated room. The safety measure may make an alert that there is a remaining person in the designated room.

Figure 4:
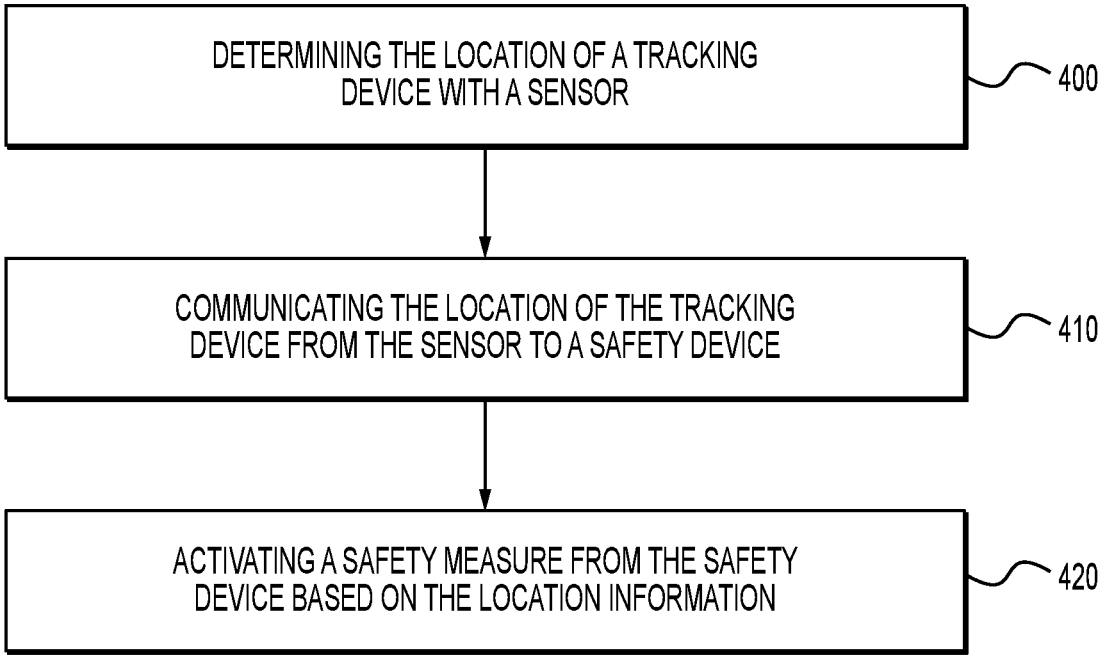
FIG. 4 is a flow diagram of a safety tracking method.

FIG. 4 is a flow diagram of a safety tracking method. The location of a tracking device is determined with a sensor in box 400. The location of the tracking device is communicated from the sensor to a safety device in box 410. A safety measure is then activated from the safety, device based on the location information in Box 420.

The tracking device, in some embodiments, is wearable and can be a ring, a bracelet, a card or any other such item.

The safety tracking method can further include activating a safety measure if the location of the tracking device is within a designated bus. The safety measure can prevent the designated bus engine from being turned off.

The safety tracking method can also include activating the safety measure if the location of the tracking device is within a designated room. The safety measure can make an alert that there is a remaining person in the designated room. The safety measure could further include preventing the locking of a door or turning off of lights.

It is to be understood that the safety tracking system and method is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A safety tracking system, comprising:

a tracking device;

a sensor that determines the location of the tracking device; and a safety device that receives the location information from the sensor and activates a safety measure based on the location information, wherein the safety measure is activated if the location of the tracking device is within a designated bus, and wherein the safety measure prevents the designated bus engine from being turned off.

2. The safety tracking system as recited in claim 1, wherein the tracking device is wearable.

3. The safety tracking system as recited in claim 1, wherein the tracking device is a ring.

4. The safety tracking system as recited in claim 1, wherein the tracking device is a bracelet.

5. The safety tracking system as recited in claim 1, wherein the tracking device is a card.

6. The safety tracking system as recited in claim 1, wherein the safety measure is activated if the location of the tracking device is within a designated room.

7. The safety tracking system as recited in claim 6, wherein the safety measure makes an alert that there is a remaining person in the designated room.

8. A safety tracking method, comprising:

determining the location of a tracking device with a sensor;

communicating the location of the tracking device from the sensor to a safety device;

activating a safety measure from the safety device based on the location information, and activating a safety measure if the location of the tracking device is within a designated bus, wherein the safety measure prevents the designated bus engine from being turned off.

9. The safety tracking method as recited in claim 8, wherein the tracking device is wearable.

10. The safety tracking method as recited in claim 8, wherein the tracking device is a ring.

11. The safety tracking method as recited in claim 8, wherein the tracking device is a bracelet.

12. The safety tracking method as recited in claim 8, wherein the tracking device is a card.

13. The safety tracking method as recited in claim 8, further comprising activating the safety measure if the location of the tracking device is within a designated room.

14. The safety tracking method as recited in claim 8, wherein the safety measure makes an alert that there is a remaining person in the designated room.

* * * * *